US005727901A

United States Patent [19]

Rennie et al.

[11] Patent Number: 5,727,901

[45] Date of Patent: Mar. 17, 1998

[54] COLLECTION TANK

[76] Inventors: David G. Rennie, 23 Zacharias Pl., Winnipeg, Canada, R2G 3G8; James M. Adams, 102 Smugglers Cove, Winnipeg, Canada, R3X 1R7; William R. McDuffe; A. Barbara Corrigal, both of 10 Beaudin Blvd., Elie, Canada, R0H 0H0

[21] Appl. No.: 588,569

[22] Filed: Jan. 18, 1996

[51] Int. Cl.[6] ..... E02D 31/02

[52] U.S. Cl. ..... 405/45; 405/36; 405/43; 52/169.5

[58] Field of Search ..... 405/36, 52, 43, 405/41, 40, 53; 52/169.5, 302.3, 302.1, 19, 20; 137/312, 357, 363, 302; 404/2

[56] References Cited

U.S. PATENT DOCUMENTS

| | | | |
|---|---|---|---|
| 3,428,077 | 2/1969 | Scarfe | 405/36 X |
| 4,031,009 | 6/1977 | Hicks | 405/36 X |
| 4,253,282 | 3/1981 | Swartz | 137/363 |
| 4,298,294 | 11/1981 | Zimmerman | 52/169.5 X |
| 4,553,561 | 11/1985 | Morris | 137/362 |
| 4,983,069 | 1/1991 | Florence | 405/36 X |
| 5,551,797 | 9/1996 | Sanford | 52/169.5 |

FOREIGN PATENT DOCUMENTS

| | | | |
|---|---|---|---|
| 72125 | 1/1951 | Denmark | 405/36 |
| 1544054 | 9/1968 | France | 404/2 |
| 2666361 | 3/1992 | France | 405/36 |
| 161520 | 7/1984 | Japan | 405/43 |
| 1504310 | 8/1989 | U.S.S.R. | 405/43 |
| 601429 | 6/1994 | WIPO | 404/2 |

OTHER PUBLICATIONS

Brochure "SuperSump" (1 page).

*Primary Examiner*—Tamara L. Graysay
*Assistant Examiner*—Frederick L. Lagman
*Attorney, Agent, or Firm*—Adrian D. Battison; Murray E. Thrift

[57] ABSTRACT

The present invention provides a collection tank for use under the floor slab of a building or slab on grade for collecting ground water from the surrounding soil and from weeping tiles. The collection tank comprises a collection tank having an upper tank portion and a lower tank portion, a plurality of perforations in the upper tank portion of the containment tank portion for receiving ground water, a plurality of cut-out ports in the outer wall of the upper tank portion of the collection tank each for receiving an end of a respective weeping tile line, an overflow port for communicating excess water to an overflow line, and a pump for pumping water in the collection tank to a location external of the collection tank. The collection tank also includes one or more collection tank extensions which can be added to the top of the collection tank to ensure that the weeping tile lines, when connected, are positioned at the proper angle to ensure efficient water flow into the collection tank. The collection tank extensions also allow the collection tank to be positioned at the correct depth to achieve the desired sub-surface water level.

20 Claims, 3 Drawing Sheets

COLLECTION TANK

FIELD OF THE INVENTION

The present invention provides a collection tank for installing under a building or a slab on grade, for collecting ground water and water from weeping tiles, and for containing the water away from the building or slab.

SUMMARY OF THE INVENTION

It is one object of the present invention to provide an improved collection tank having superior fluid collecting ability.

It is another object of the present invention to provide a collection tank extension which can be added to the top of the collection tank or another collection tank extension to ensure that the weeping tile lines, when connected, are positioned at the proper angle to ensure efficient water flow into the collection tank.

It is another object of the present invention to provide a collection tank extension which can be added to the top of the collection tank or another collection tank extension to achieve the desired sub-surface water level.

According to one aspect of the present invention there is provided a collection tank for collecting ground water from surrounding soil and from weeping tiles, said collection tank comprising: a lower tank portion having an open top wall, an outer wall, and a closed bottom wall; an upper tank portion being narrower than the lower tank portion and having a top wall with an opening therethrough, an outer wall, and an open bottom; a connecting wall extending from the top edge of the lower tank portion to the bottom edge of the upper tank portion thereby fixing the bottom edge of the upper tank portion to the top edge of the lower tank portion; and wherein the upper and lower tank portions are frusto-conical such that the respective outer walls of each of the upper and lower tank portions taper upwards and inwards from a bottom edge to a top edge.

The collection tank is usually installed under the floor slab of a building or a slab on grade however it may be installed in any appropriate location.

The upper tank portion preferably includes a plurality of perforations in the outer wall for receiving ground water therethrough. The plurality of perforations are arranged in a spaced apart pattern comprising a plurality of diagonal rows progressing around the outer wall of the upper tank portion and extending from near the top of the upper tank portion to the bottom of the upper tank portion. Perforations having a diameter of about 1 cm are believed to provide for good fluid collection.

The upper tank portion also includes a plurality of cut-out ports in the outer wall. Each one of the plurality of cut-out ports is arranged for receiving an end of a respective weeping tile line. The cut-out ports are spaced angularly around the outer wall of the upper tank portion of the collection tank. An overflow cut-out port is arranged in the upper tank portion for communicating excess water therethrough to an attached overflow line.

The connecting wall also includes a plurality of perforations for receiving ground water therethrough. Like the perforations in the outer wall the perforations in the connecting wall are arranged in a spaced apart pattern.

The lower tank portion preferably includes a raised pump platform extending upwards from an internal bottom surface of the bottom wall of the lower tank portion. The pump platform includes a substantially horizontal pump supporting surface raised upwards from the internal bottom surface of the lower tank portion of the collection tank. The pump platform is located at a center of the interior bottom wall of the lower tank portion of the collection tank. A pump is arranged on the pump platform and includes a pump outlet line extending upwards from the pump through an opening in the top of the upper tank portion to a location external of the collection tank.

The upper tank portion of the collection tank preferably includes a top wall having an opening and a removable lid. The lid is fastened to the top wall by removable and reengageable fastening means. The lid includes sealing means, preferably a rubber gasket, arranged to lie between the lid and the top wall of the upper tank portion of the collection tank.

According to a second aspect of the present invention there is provided a collection tank for collecting ground water from surrounding soil and from weeping tiles, said collection tank comprising: a main tank having a top wall with an opening therethrough and having an outer wall with a top edge arranged around the periphery of the top wall; and a collection tank extension including: a top wall with an first opening therethrough, an outer wall being sized and arranged to align with the top edge of the outer wall of the main tank, an bottom wall with an second opening therethrough, a plurality of perforations in the outer wall for receiving ground water therethrough; a plurality of cut-out ports in the outer wall each being arranged for receiving an end of a respective weeping tile line; an overflow cut-out port in the outer wall for communicating excess water to an overflow line; and attachment means for fixing the collection tank extension to the top wall of the main tank such that the second opening of the bottom wall of the collection tank extension is aligned with the opening in the top wall of the main tank.

The top of each collection tank extension is preferably designed to accommodate the attachment of another collection tank extension.

In an alternative usage the collection tank can be used as a well for accumulating and storing ground water for later use. One or more tank extensions can be used to increase the depth to which the tank can be installed in the ground thereby giving the well greater depth.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
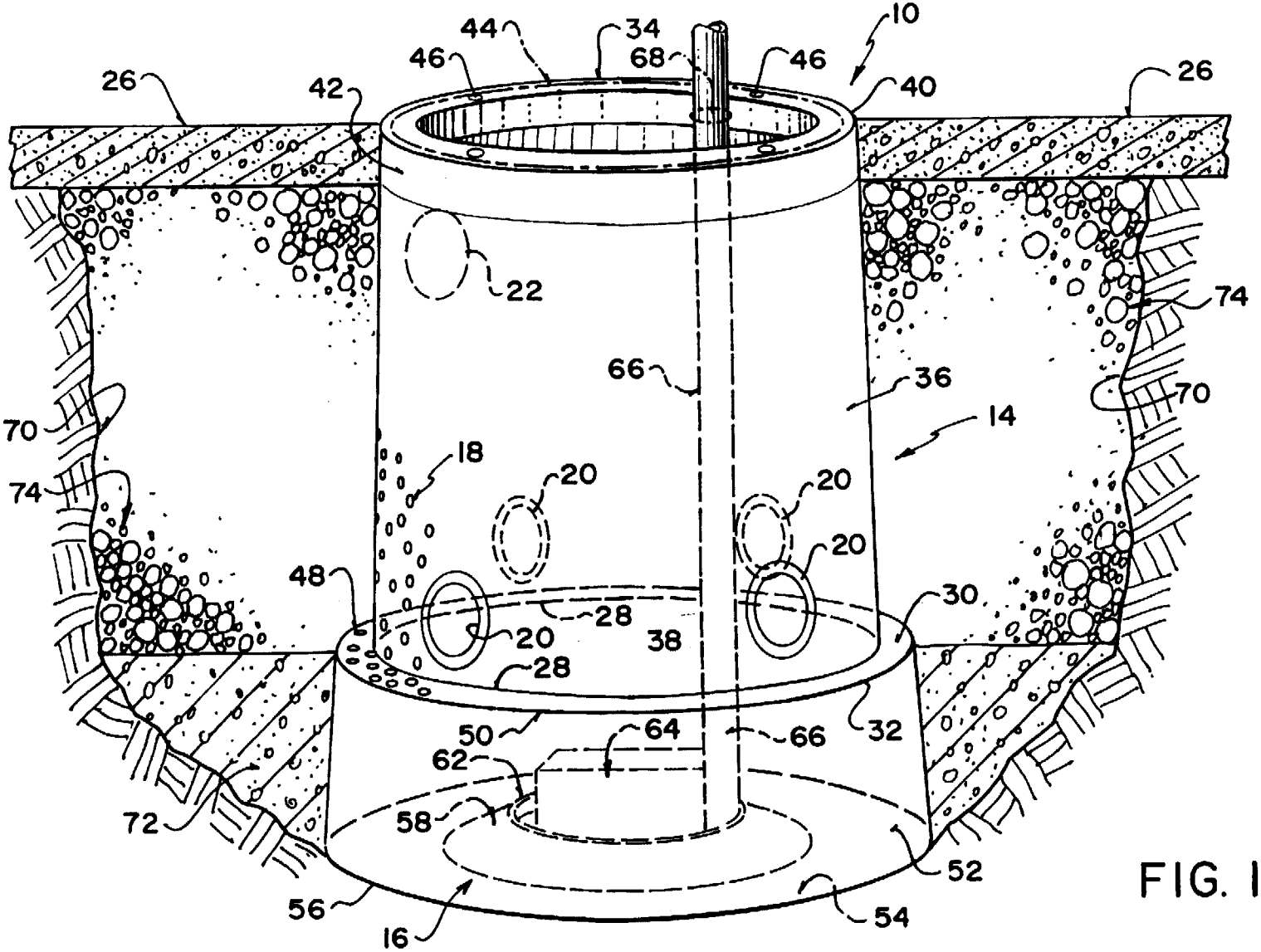
FIG. 1 is an isometric view of the collection tank.
Figure 2:
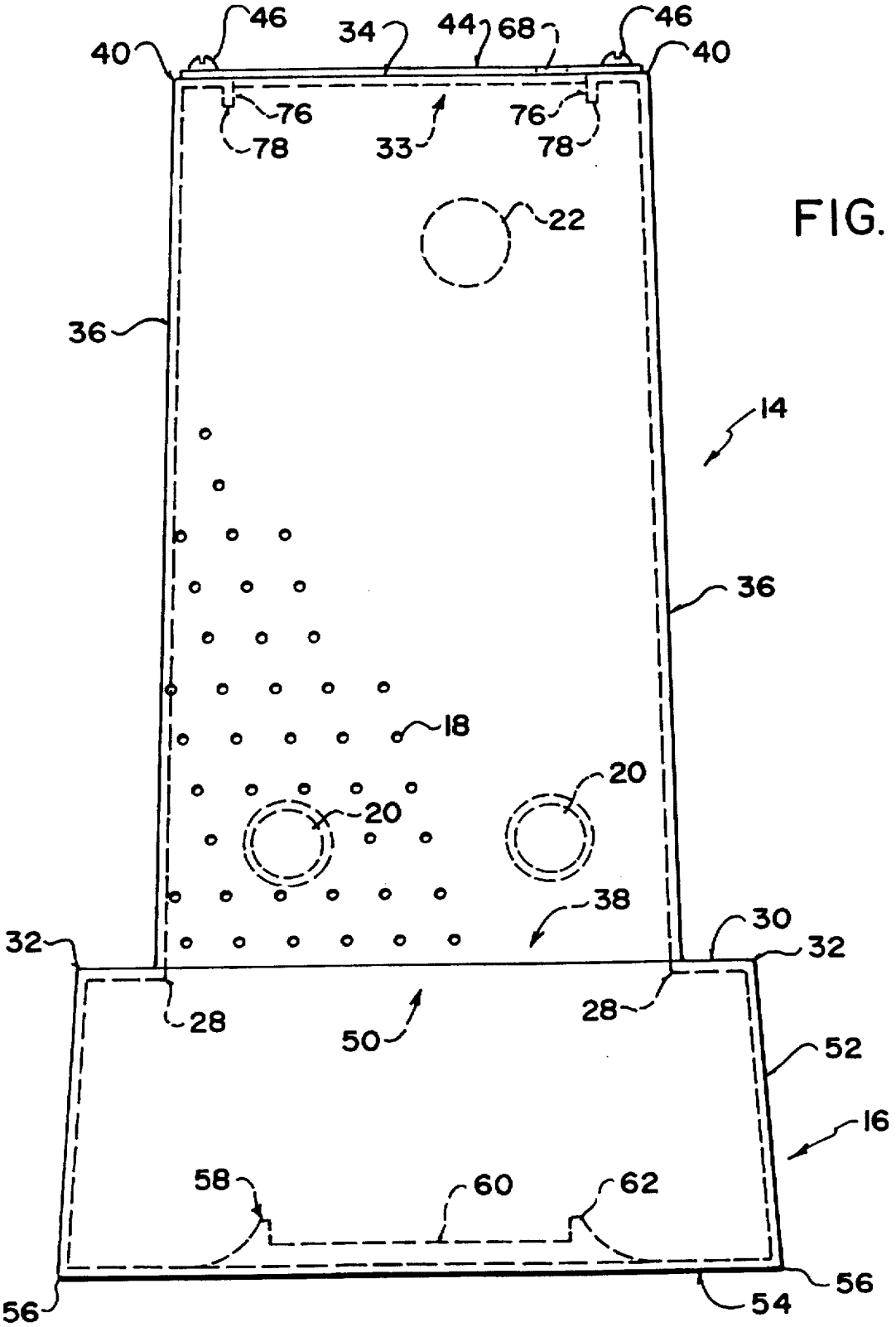
FIG. 2 is a front view of the collection tank.

Referring to FIG. 1 a preferred embodiment of the collection tank is shown generally at 10. The collection tank 10 comprises an upper tank portion 14 and a lower tank portion 16, a plurality of perforations 18 in the upper tank portion 14 for receiving ground water therethrough, a plurality of cut-out ports 20 in the upper tank portion 14, an overflow cut-out port 22 for communicating excess water therethrough to an attached overflow line, and a pump 64 for pumping water in the collection tank 10 to a location external of the collection tank 10.

The collection tank 10 is usually installed under the floor slab 26 of a building or a slab on grade for accumulating ground water from soil surrounding the collection tank 10, and water collected by weeping tiles running under the building or slab on grade.

The collection tank 10 includes the upper tank portion 14 and the lower tank portion 16. The upper tank portion 14 is preferably narrower than the lower tank portion 16 and is arranged such that the upper tank portion 14 is fixed to the lower tank portion 16 by a connecting wall 32. The connecting wall 32 extends from the top edge 32 of the lower tank portion 16 to the bottom edge 28 of the upper tank portion.

The upper tank portion 14 includes a top wall 34, a first outer wall 36, and an open bottom 38. The first outer wall 36 is frusto-conical tapering upwards and inwards from a bottom edge 28 to a top edge 40. The outer wall 36 includes the plurality of perforations 18 which allow for the flow of ground water in the ground surrounding the collection tank 10 through the first outer wall 36 and into the collection tank 10. A topmost portion 42 of the first outer wall 36 has no perforations and starts at the top edge 40 of the first outer wall 36 extending downwards about 4 inches.

The plurality of perforations 18 are arranged in a spaced apart pattern and comprise a plurality of diagonal rows progressing around the first outer wall 36. Each of the diagonal rows extends from the bottom of the top most portion 42 of the first outer wall 36 downwards to the bottom 28 of the first outer wall 36. A size of about 1 cm in diameter for each one of the perforations, with a spacing of about 5 cm between each of the perforations has been found to be effective for accumulating water from the ground in the collection tank 10. It is believed that having the perforations 18 arranged in diagonal rows increases the likelihood that water flowing down the outer wall 36 of the tank 10 will encounter one of the perforations 18 and enter the collection tank 10.

The upper tank portion 14 includes a plurality of cut-out ports 20 in the first outer wall 36 positioned adjacent the bottom end 28 of the upper tank portion 14. The cut-out ports 20 are spaced angularly around the first outer wall 36 of the upper tank portion 14 and are sized and arranged for receiving an outlet end of a respective weeping tile line. Four circular cut-out ports 20 are preferable for receiving the outlet ends of four respective weeping tile lines, however, any appropriate number of cut-out ports may be provided to accommodate the corresponding weeping tile ends.

The upper tank portion 14 also includes an overflow cut-out port 22 in the first outer wall 36 for communicating excess water to the inlet end of an overflow line. The overflow cut-out port 22 is arranged adjacent the top end 40 of the upper tank portion 14 and is sized and arranged for receiving an inlet end of an overflow line. One circular overflow cut-out port 22 is usually provided, however, any appropriate number of overflow cut-out ports may be provided.

The top wall 34 includes an opening 33 and a lid 44. The opening 33 allows access to the collection tank 10 and includes an annular flange 76 arranged around the opening 33 and extending downwards therefrom. The flange 76 is engaged on a bottom edge 78 by the attachment means of the collection tank extension 80 when an extension tank 80 is in use.

The lid 44 covers the opening 33 in the top wall 34 of the upper tank portion 14 thereby closing off the collection tank 10. The lid 44 is fastened to the top wall 34 by removable and reengageable fastening means 46, preferably screws or bolts, and includes sealing means 48 to prevent the escape of any harmful or unpleasant gases which may have been collected in the tank 10 with the ground water. The sealing means 48 preferably comprise a rubber gasket, which is arranged to lie between the lid 44 and the top wall 34 of the upper tank portion 14.

The connecting wall 30 extending from the top edge 32 of the lower tank portion 10 to the bottom edge 28 of the upper tank portion 14 includes a plurality of perforations 48. The plurality of perforations 48, like those in the upper tank portion 14, are arranged in a spaced apart pattern. Each one of the perforations 48 is also about 1 cm in diameter and spaced about 5 cm apart.

The lower tank portion 16 includes an open top 50, a second outer wall 52, and a closed bottom wall 54. The lower tank portion 16 is larger in diameter than the upper tank portion 14. The lower tank portion 16 like the upper tank portion 14 is frusto-conical tapering upwards and inwards from a bottom end 56 to a top end 32. The lower tank portion 16 has no perforations.

The lower tank portion 16 includes a raised pump platform 58 extending upwards from a bottom surface 54 of the lower tank portion 16. The pump platform 58 includes a substantially horizontal pump supporting surface 60 raised upwards from the internal bottom surface 54 of the lower tank portion 16 and a peripheral edge 62 surrounding the pump supporting surface 60. The peripheral edge 62 slopes upwards an inwards towards the pump supporting surface 58 and extends above the pump supporting surface 60 forming a lip therearound. The pump platform 58 is preferably located at a center of the interior surface of the bottom wall 54 of the lower tank portion 16. The pump platform 58 is arranged to lie above most of the sediment that accumulates on the bottom wall 54. This helps keep sediment from accumulating at the pump inlet.

The pump 64 is provided for pumping water in the collection tank 10 to a location external of the collection tank 10. The pump 64 includes a pump outlet line 66 extending upwards from the pump through the lower tank portion 16 and upper tank portion 14 to an opening 68 in the lid 44 on top of the upper tank portion 14. The outlet line 68 terminates at a location external of the collection tank 10 and allows water which has collected in the lower tank portion 16 to be pumped up and out of the tank 10.

Figure 3:
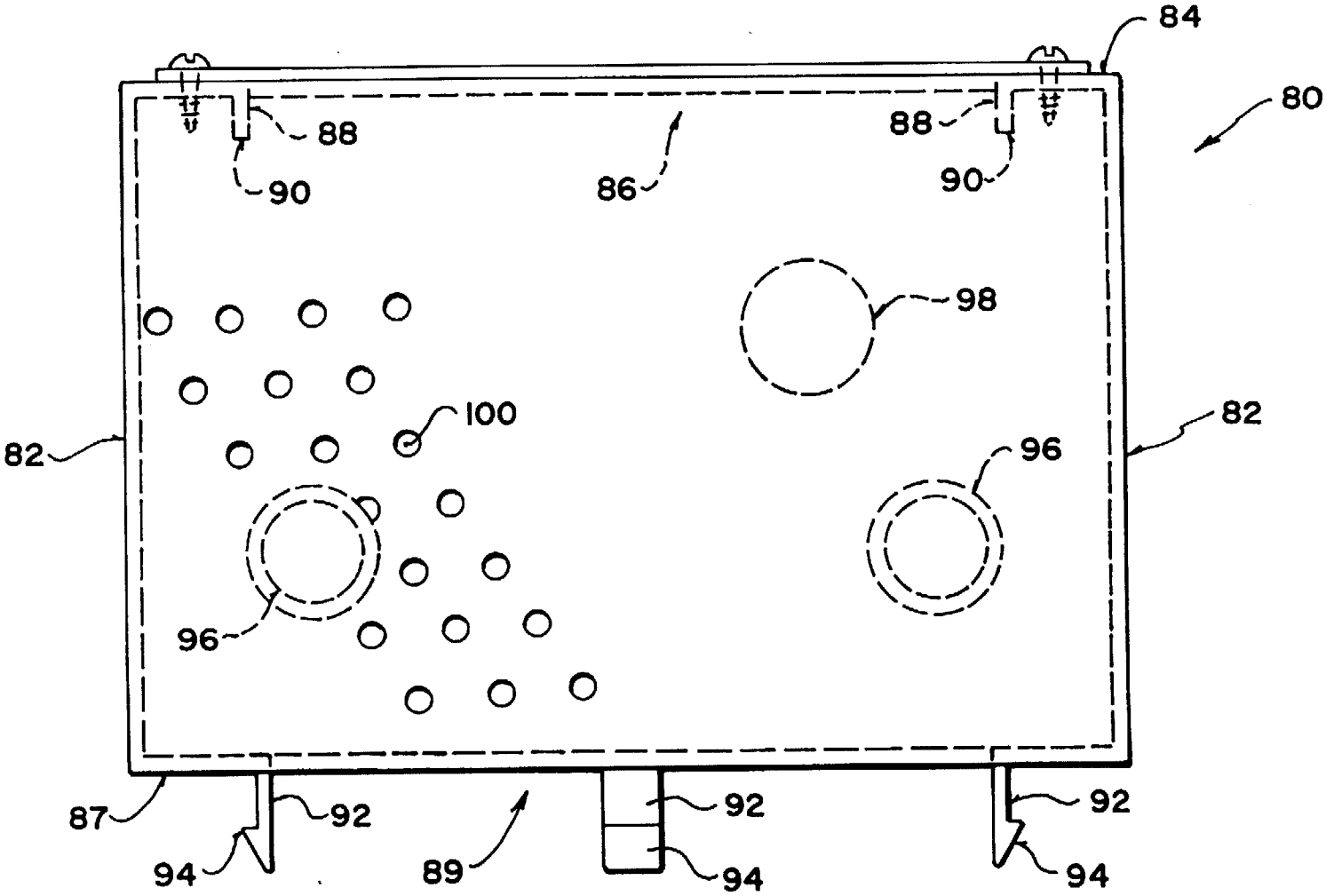
FIG. 3 is a front view of the collection tank extension.

Referring to FIG. 3 the collection tank 10 also includes a collection tank extension 80 which can be added to the top of the collection tank 10 or to another collection tank extension 80 to ensure that the weeping tile lines, when connected, are positioned at the proper angle to ensure efficient water flow into the collection tank 10. The collection tank extension also allows for the collection tank to be positioned at the correct depth to achieve the desired subsurface water level.

The collection tank extension 80 includes a top wall 84 with a first opening 86 therethrough, an outer wall 82 being sized and arranged to align with the top edge of the outer wall of the collection tank 10, and a bottom wall 87 with an second opening 89 therethrough. The first opening 86 includes an annular flange 88, like that on the collection tank, arranged around the opening 86 and extending downwards therefrom. The flange 88 is engaged on a bottom edge 90 by the attachment means of a second collection tank extension when more than one extension is in use.

The collection tank extension 80 also includes a plurality of perforations 100 in the outer wall 82, a plurality of cut-out ports 96 in the outer wall 82, and an overflow cut-out port 98 in the outer wall 82. These have the same characteristics and function as those described above for the upper portion 14 of the collection tank 10.

Attachment means fix the collection tank extension 80 to the top wall 34 of the collection tank 10 or to another tank extension. When attached the outer wall 82 of the collection tank extension 80 is arranged to align with the outer wall 36 of the collection tank 10 such that the second opening 89 of the bottom wall 87 of the collection tank extension 80 is aligned with the opening 33 in the top wall 34 of the collection tank 10. The attachment means comprise at least one flange 92, preferably four, extending downwards from an edge of the second opening 89 in the bottom wall 87. Each one of the flanges 92 has an engagement member 94 arranged at a bottom end and extending laterally outwards therefrom. The collection tank extension 80, when in place for use, is positioned such that the flanges 92 are arranged to lie adjacent the annular flange 76 of the collection tank 10 such that the engagement member 94 engages the bottom end 78 of the annular flange 76. This holds the collection tank extension 80 in place on top of the collection tank 10. A seal can be placed between the collection tank extension 80 and the collection tank 10 to ensure water does not escape therebetween. The attachment means engage the flange 88 of a collection tank extension 80 in the same manner as they engage the flange 76 of the collection tank 10.

In use, see FIG. 1, the collection tank 10 is placed in a hole 70 which is dug in the ground such that it will be located beneath where the floor slab 26 of the building is to be located. The hole 70 is made large enough in diameter to receive the lower portion 16 of the collection tank 10 and flares outwards and upwards to the surface of the hole. The collection tank 10 is placed in the hole with the bottom wall 54 of the lower portion 16 of the tank 10 resting on the bottom of the hole 54.

The cut-out ports 20 are removed from the collection tank 10 and the overflow outlet line, and the weeping tile lines are installed. Once the tank 10 is in place in the hole 70 with the overflow outlet line and the weeping tile lines installed, the hole 70 is then back filled. The bottom of the hole around the lower portion of the tank is preferably filled in with a slurry mix 72 such as concrete or other substantially moisture impervious material. The remainder of the hole 70 surrounding the upper portion 14 of the tank 10 is filled with a granular fill 74 such as gravel or other material which provides good drainage. The slurry mix prevents water in the ground around the collection tank from flowing downwards past the tank. The ground water passes through the granular material and drains into the collection tank 10.

Water is collected by the weeping tiles and the perforations 18 and flows into the upper tank portion 14. The water then flows downwards through the open bottom 38 of the upper tank portion 14 and through the open top 50 of the lower tank portion 16 collecting in the lower tank portion 16.

Water flowing down over the outer wall 36 of the tank 10 that is not captured by the diagonally arranged perforations 18 of the upper portion 14 of the collection tank 10 will flow onto the connecting wall 30 arranged between the upper and lower portions 14 and 16. The perforations 48 in the connecting wall 30 allow this water to enter the lower portion 16 of the collection tank 10 from above.

Water is removed from the tank 10 by the pump 64 which pumps the water upwards and out of the top 34 of the upper portion 14 of the tank 10 to a location external of the tank. If the water level in the tank 10 approaches the top 34 of the upper portion 14 or of an attached extension tank, despite pumping out water as it is collected, the excess water is drained off by the over flow line thereby preventing water from flooding out of the top 34 of the collection tank 10 and into the building.

In an alternative usage the collection tank can be used as a well for accumulating and storing ground water for later use. One or more tank extensions can be used to increase the depth to which the tank can be installed in the ground thereby giving the well greater depth.

While one embodiment of the present invention has been described in the foregoing, it is to be understood that other embodiments are possible within the scope of the invention. The invention is to be considered limited solely by the scope of the appended claims.

I claim:

1. A collection tank for mounting under a floor of a building for collecting ground water from an area under the floor comprising:

a tank body defining:

a lower reservoir portion having a closed bottom wall and an outer wall generally upstanding from the bottom wall, the outer wall and the bottom wall being closed and imperforate to define a container for collected water with an open top;

an upper tank portion having a bottom edge connected to the lower reservoir portion at the open top and having an outer wall generally upstanding from the open top, the outer wall of the upper tank portion being perforated with holes arranged in an array extending around a full periphery of the outer wall of the upper tank portion and extending from the bottom edge upwardly for passage of ground water through the array of holes into the tank body and the upper tank portion having an open bottom for communication of the ground water into the lower reservoir portion;

and a pump located in the lower reservoir portion so as to pump water from the lower reservoir portion at a position below the open top and below the holes in the upper tank portion;

wherein a top edge of the outer wall of the lower reservoir portion is spaced outwardly from the bottom edge of the outer wall of the upper tank portion and wherein there is provided a generally horizontal annular connecting wall extending from the top edge of the outer wall of the lower reservoir portion inwardly to the bottom edge of the outer wall of the upper tank portion, the connecting wall being perforated with an array of holes to allow water running down an outer surface of the outer wall of the upper tank portion to enter through the holes in the connecting wall into the lower reservoir portion.

2. The collection tank according to claim 1 wherein the outer wall of the upper tank portion is frusto-conical such that the outer wall of the upper tank portion tapers upwardly and inwardly.

3. The collection tank in accordance with claim 1 wherein the array of holes in the outer wall of the upper tank portion is arranged such that the holes lie in rows which are diagonal relative to vertical such that water running vertically down an outer surface of the outer wall when missing one hole in a row will more likely encounter a next adjacent lower hole in the row.

4. The collection tank in accordance with claim 1 wherein the lower reservoir portion includes a pump platform including a substantially horizontal pump supporting surface raised above the bottom wall and a peripheral wall surrounding the pump supporting surface and extending to a height above the supporting surface so as to form a raised lip therearound.

5. The collection tank in accordance with claim 4 wherein peripheral wall of the pump platform is frusto-conical so as to slope upwardly and inwardly from the bottom wall towards the pump supporting surface.

6. A collection tank for mounting under a floor of a building for collecting ground water from an area under the floor comprising:

a tank body defining:

a lower reservoir portion having a closed bottom wall and an outer wall generally upstanding from the bottom wall, the outer wall and the bottom wall being closed and imperforate to define a container for collected water with an open top;

the lower reservoir portion being arranged for receiving a pump located in the lower reservoir portion so as to pump water from the lower reservoir portion;

an upper tank portion having a bottom edge connected to the lower reservoir portion at the open top and having an outer wall generally upstanding from the open top;

the outer wall of the upper tank portion being frusto-conical such that the outer wall of the upper tank portion tapers upwardly and inwardly from the bottom edge;

the outer wall of the upper tank portion being perforated with holes arranged in an array extending around a full periphery of the outer wall of the upper tank portion and extending from the bottom edge upwardly for passage of ground water through the array of holes into the tank body;

the upper tank portion having an open bottom for communication of the ground water into the lower reservoir portion;

a top edge of the outer wall of the lower reservoir portion being spaced outwardly from the bottom edge of the upper tank portion;

and a generally horizontal annular connecting wall extending from the top edge of the lower reservoir portion inwardly to the bottom edge of the outer wall of the upper tank portion, the connecting wall being perforated with an array of holes to allow water running down an outer surface of the outer wall of the upper tank portion to enter through the holes in the connecting wall into the lower reservoir portion.

7. The collection tank in accordance with claim 6 wherein the array of holes in the outer wall of the upper tank portion is arranged such that the holes lie in rows which are diagonal relative to vertical such that water running vertically down an outer surface of the outer wall when missing one hole in a row will more likely encounter a next adjacent lower hole in the row.

8. The collection tank in accordance with claim 6 wherein the lower reservoir portion includes a pump platform including a substantially horizontal pump supporting surface raised above the bottom wall and a peripheral wall surrounding the pump supporting surface and extending to a height above the supporting surface so as to form a raised lip therearound.

9. The collection tank in accordance with claim 8 wherein peripheral wall of the pump platform is frusto-conical so as to slope upwardly and inwardly from the bottom wall towards the pump supporting surface.

10. The collection tank in accordance with claim 9 wherein the pump platform is located on the bottom wall at a position thereon spaced inwardly from the outer wall of the reservoir portion.

11. The collection tank in accordance with claim 6 wherein the upper tank portion includes a top wall at an upper edge of the outer wall of the upper tank portion with an opening therein and a removable lid covering the opening and fastened by removable and reengageable fastening means to the top wall of the upper tank portion.

12. The collection tank in accordance with claim 6 including a collection tank extension portion having a top wall with an opening therethrough, an outer wall aligned with the outer wall of the upper tank portion, a bottom wall with an opening therethrough, and attachment means for fixing the extension portion to a top wall of the upper tank portion.

13. The collection tank in accordance with claim 12 wherein the extension portion includes a plurality of perforations in the outer wall for receiving ground water therethrough.

14. The collection tank in accordance with claim 6 wherein the outer wall of the lower reservoir portion is frusto-conical so as to taper upwardly and inwardly from the bottom wall to an upper edge of the outer wall at the open top.

15. A collection tank for mounting under a floor of a building for collecting ground water from an area under the floor comprising:

a tank body defining:

a lower reservoir portion having a closed bottom wall and an outer wall generally upstanding from the bottom wall, the outer wall and the bottom wall being closed and imperforate to define a container for collected water with an open top;

an upper tank portion having a bottom edge connected to the lower reservoir portion at the open top and having an outer wall generally upstanding from the open top;

the outer wall of the upper tank portion being perforated with holes arranged in an array extending around a full periphery of the outer wall of the upper tank portion and extending from the bottom edge upwardly for passage of ground water through the array of holes into the tank body;

the upper tank portion having an open bottom for communication of the ground water into the lower reservoir portion;

a pump platform in the reservoir portion above the bottom wall including a substantially horizontal pump supporting surface raised above the bottom wall and a peripheral wall surrounding the pump supporting surface and extending to a height above the supporting surface so as to form a raised lip therearound.

16. The collection tank in accordance with claim 15 wherein peripheral wall of the pump platform is frusto-conical so as to slope upwardly and inwardly from the bottom wall towards the pump supporting surface.

17. The collection tank in accordance with claim 15 wherein the pump platform is located on the bottom wall at a position thereon spaced inwardly from the outer wall of the reservoir portion.

18. The collection tank in accordance with claim 15 wherein the array of holes in the outer wall of the upper tank portion is arranged such that the holes lie in rows which are diagonal relative to vertical such that water running vertically down an outer surface of the outer wall when missing one hole in a row will more likely encounter a next adjacent lower hole in the row.

19. The collection tank in accordance with claim 15 wherein the outer wall of the lower reservoir portion is frusto-conical so as to taper upwardly and inwardly from the bottom wall to an upper edge of the outer wall at the open top.

20. A collection tank for mounting under a floor of a building for collecting ground water from an area under the floor comprising:

a tank body defining:

a lower reservoir portion having a closed bottom wall and an outer wall generally upstanding from the bottom wall, the outer wall and the bottom wall being closed and imperforate to define a container for collected water with an open top;

the lower reservoir portion being arranged for receiving a pump located in the lower reservoir portion so as to pump water from the lower reservoir portion;

an upper tank portion having a bottom edge connected to the lower reservoir portion at the open top and having an outer wall generally upstanding from the open top;

the outer wall of the upper tank portion being perforated with holes arranged in an array extending around a full periphery of the outer wall of the upper tank portion and extending from the bottom edge upwardly for passage of ground water through the array of holes into the tank body;

the upper tank portion having an open bottom for communication of the ground water into the lower reservoir portion;

the outer wall of the lower reservoir portion being frustoconical so as to taper upwardly and inwardly from the bottom wall to an upper edge of the outer wall at the open top.

* * * * *